US010382879B1

(12) United States Patent
Akama et al.

(10) Patent No.: US 10,382,879 B1
(45) Date of Patent: Aug. 13, 2019

(54) VIRTUAL SOUND FIELD

(71) Applicant: Honda Motor Co., Ltd., Tokyo (JP)

(72) Inventors: Shinichi Akama, Cupertino, CA (US); Shigeyuki Seko, Campbell, CA (US)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 16/177,961

(22) Filed: Nov. 1, 2018

(51) Int. Cl.

| | |
|---|---|
| ***H04S 7/00*** | (2006.01) |
| ***H04R 3/00*** | (2006.01) |
| ***H04R 3/12*** | (2006.01) |
| ***H04R 5/027*** | (2006.01) |
| ***H04R 5/02*** | (2006.01) |
| ***H04R 5/04*** | (2006.01) |

(52) U.S. Cl.
CPC ..... *H04S 7/303* (2013.01); *H04R 3/005* (2013.01); *H04R 3/12* (2013.01); *H04R 5/02* (2013.01); *H04R 5/027* (2013.01); *H04R 5/04* (2013.01); *H04R 2499/13* (2013.01); *H04S 2420/01* (2013.01)

(58) Field of Classification Search
CPC ... H04R 5/02; H04R 3/12; H04R 5/04; H04R 2499/13; H04R 3/005; H04R 5/027; H04S 2420/01; H04S 7/303
USPC ..... 381/300
See application file for complete search history.

(56) References Cited

U.S. PATENT DOCUMENTS 9,666,207 B2 * 5/2017 Chowdhury ..... H04M 9/082

FOREIGN PATENT DOCUMENTS

JP 2005316704 11/2005

* cited by examiner

*Primary Examiner* — Paul Kim
(74) *Attorney, Agent, or Firm* — Rankin, Hill & Clark LLP

(57) ABSTRACT

Producing a virtual sound field may include receiving an audio signal associated with a remote sound source within a remote environment. The audio signal may be defined or recorded as a binaural recording and recorded from a remote set of binaural microphones. The audio signal may be indicative of a position of the remote sound source relative to the remote set of binaural microphones within the remote environment. Producing the virtual sound field may include determining a virtual position relative to the position of the remote sound source within the remote environment, generating a virtual sound field audio signal which simulates audio representing the remote sound source perceived from the virtual position within the remote environment relative to the position of the remote sound source within the remote environment, and playing back the virtual sound field to simulate the remote sound source as perceived from the virtual position.

20 Claims, 12 Drawing Sheets

VIRTUAL SOUND FIELD

BACKGROUND

Playing back sound fields may be complex. Most earphones in the market today cannot produce a natural sound field. This is because the music played back by the speakers has to go through air before entering into human ears, and the sound from the speakers is the same as various sounds in nature, which has to go through the auricles, earlaps, auditory canal, and ear drums before being sensed by the brain nerves.

BRIEF DESCRIPTION

According to one aspect, a system for producing a virtual sound field may include a communication interface, a processor, and a local set of binaural speakers. The communication interface may receive an audio signal associated with a remote sound source within a remote environment. The audio signal associated with the remote sound source may be defined as a binaural recording and may be recorded from a remote set of binaural microphones. The audio signal associated with the remote sound source may be indicative of a position of the remote sound source relative to the remote set of binaural microphones within the remote environment. The processor may determine a virtual position relative to the position of the remote sound source within the remote environment. The processor may generate a virtual sound field audio signal which simulates audio representing the remote sound source perceived from the virtual position within the remote environment relative to the position of the remote sound source within the remote environment. The local set of binaural speakers may play the virtual sound field audio signal to simulate the remote sound source as perceived from the virtual position relative to the position of the remote sound source within a local environment associated with the system for producing the virtual sound field.

The system for producing the virtual sound field may include a local set of binaural microphones receiving an audio signal associated with a local sound source within the local environment. The audio signal associated with the local sound source may be defined as a binaural recording and recorded from the local set of binaural microphones. The audio signal associated with the local sound source may be indicative of the local sound source being positioned at the virtual position relative to the remote sound source. The remote set of binaural microphones may include 360 degree microphones.

The local environment may be within a first vehicle and the remote environment may be within a room or within a second vehicle. The local environment may be within a helmet. The processor may determine the virtual position based on a user input or a user selection. The local set of binaural speakers may play the virtual sound field audio signal based on a head related transfer function. The local set of binaural speakers may play the virtual sound field audio signal based on reflections of sound waves within the local environment.

According to one aspect, a method for producing a virtual sound field may include receiving an audio signal associated with a remote sound source within a remote environment. The audio signal associated with the remote sound source may be defined as a binaural recording and may be recorded from a remote set of binaural microphones. The audio signal associated with the remote sound source may be indicative of a position of the remote sound source relative to the remote set of binaural microphones within the remote environment. The method for producing the virtual sound field may include determining a virtual position relative to the position of the remote sound source within the remote environment, generating a virtual sound field audio signal which simulates audio representing the remote sound source perceived from the virtual position within the remote environment relative to the position of the remote sound source within the remote environment, and playing back the virtual sound field audio signal to simulate the remote sound source as perceived from the virtual position relative to the position of the remote sound source within a local environment.

The method for producing the virtual sound field may include receiving an audio signal associated with a local sound source within the local environment. The audio signal associated with the local sound source may be defined as a binaural recording and recorded from a local set of binaural microphones. The audio signal associated with the local sound source may be indicative of the local sound source being positioned at the virtual position relative to the remote sound source. The local environment may be within a first vehicle. The remote environment may be within a room or within a second vehicle. The local environment may be within a helmet.

According to one aspect, a system for producing a virtual sound field may include a communication interface, a processor, and a local set of binaural speakers. The communication interface may receive an audio signal associated with a remote sound source within a remote environment. The remote sound source may be a virtual sound source and the remote environment may be a virtual environment. The audio signal associated with the remote sound source may be defined as a binaural recording. The audio signal associated with the remote sound source may be indicative of a position of the remote sound source relative to the remote environment. The processor may determine a virtual position relative to the position of the remote sound source within the remote environment. The processor may generate a virtual sound field audio signal which simulates audio representing the remote sound source perceived from the virtual position within the remote environment relative to the position of the remote sound source within the remote environment. The local set of binaural speakers may play the virtual sound field audio signal to simulate the remote sound source as perceived from the virtual position relative to the position of the remote sound source within a local environment associated with the system for producing the virtual sound field.

The local environment may be within a vehicle. The local environment may be within a helmet. The processor may determine the virtual position based on a user input or a user selection.

DETAILED DESCRIPTION

Figure 1:
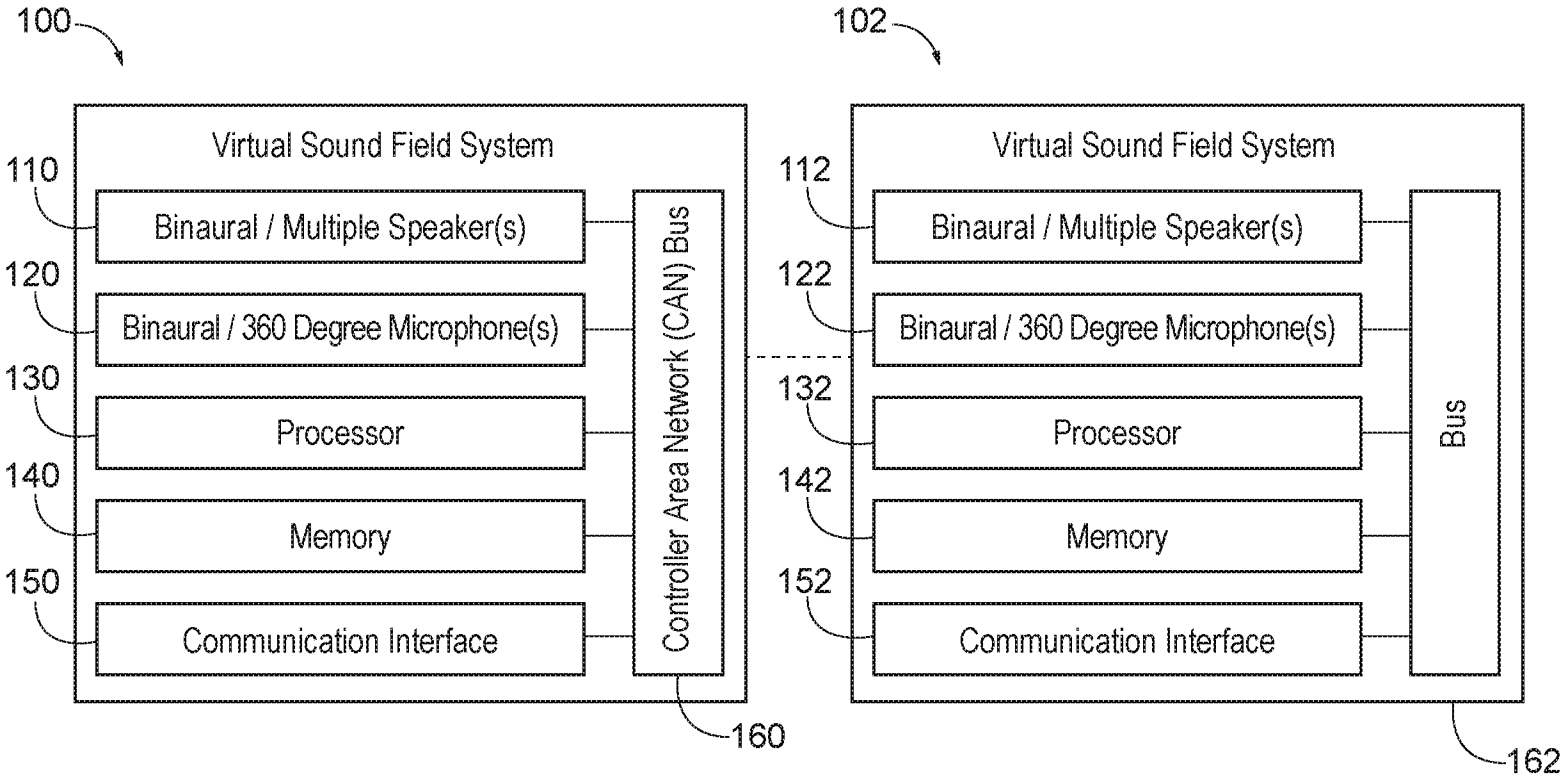
FIG. 1 is a block diagram of an exemplary system for producing a virtual sound field, according to one aspect.

The following includes definitions of selected terms employed herein. These definitions include various examples and/or forms of components that fall within the scope of a term and that may be used for implementation. The examples are not intended to be limiting. Further, one having ordinary skill in the art will appreciate that the components discussed herein, may be combined, omitted or organized with other components or organized into different architectures.

A "processor", as used herein, processes signals and performs general computing and arithmetic functions. Signals processed by the processor may include digital signals, data signals, audio signals, computer instructions, processor instructions, messages, a bit, a bit stream, or other means that may be received, transmitted, and/or detected. Generally, the processor may include a variety of various processors including multiple single and multicore processors and co-processors and other multiple single and multicore processor and co-processor architectures. The processor may include various modules to execute various functions.

A "memory", as used herein, may include volatile memory and/or non-volatile memory. Non-volatile memory may include, for example, ROM (read only memory), PROM (programmable read only memory), EPROM (erasable PROM), and EEPROM (electrically erasable PROM). Volatile memory may include, for example, RAM (random access memory), synchronous RAM (SRAM), dynamic RAM (DRAM), synchronous DRAM (SDRAM), double data rate SDRAM (DDRSDRAM), and direct RAM bus RAM (DRRAM). The memory may store an operating system that controls or allocates resources of a computing device.

A "disk" or "drive", as used herein, may be a magnetic disk drive, a solid state disk drive, a floppy disk drive, a tape drive, a Zip drive, a flash memory card, and/or a memory stick or may be a type of memory. Furthermore, the disk may be a CD-ROM (compact disk ROM), a CD recordable drive (CD-R drive), a CD rewritable drive (CD-RW drive), and/or a digital video ROM drive (DVD-ROM). The disk may store an operating system that controls or allocates resources of a computing device.

A "bus", as used herein, refers to an interconnected architecture that is operably connected to other computer components inside a computer or between computers. The bus may transfer data between the computer components. The bus may be a memory bus, a memory controller, a peripheral bus, an external bus, a crossbar switch, and/or a local bus, among others. The bus may also be a vehicle bus that interconnects components inside a vehicle using protocols such as Media Oriented Systems Transport (MOST), Controller Area network (CAN), Local Interconnect Network (LIN), among others.

An "operable connection", or a connection by which entities are "operably connected", may be one in which signals, physical communications, and/or logical communications may be sent and/or received. An operable connection may include a wireless interface, a physical interface, a data interface, and/or an electrical interface.

A "computer communication", as used herein, refers to a communication between two or more computing devices (e.g., computer, personal digital assistant, cellular telephone, network device) and may be, for example, a network transfer, a file transfer, an applet transfer, an email, a hypertext transfer protocol (HTTP) transfer, and so on. A computer communication may occur across, for example, a wireless system (e.g., IEEE 802.11), an Ethernet system (e.g., IEEE 802.3), a token ring system (e.g., IEEE 802.5), a local area network (LAN), a wide area network (WAN), a point-to-point system, a circuit switching system, a packet switching system, among others.

A "vehicle", as used herein, refers to any moving vehicle that is capable of carrying one or more human occupants and is powered by any form of energy. The term "vehicle" includes cars, trucks, vans, minivans, SUVs, motorcycles, scooters, boats, personal watercraft, and aircraft. In some scenarios, a motor vehicle includes one or more engines. Further, the term "vehicle" may refer to an electric vehicle (EV) that is powered entirely or partially by one or more electric motors powered by an electric battery. The EV may include battery electric vehicles (BEV) and plug-in hybrid electric vehicles (PHEV). Additionally, the term "vehicle" may refer to an autonomous vehicle and/or self-driving vehicle powered by any form of energy. The vehicle may or may not carry one or more human occupants.

A "vehicle system", as used herein, may be any automatic or manual systems that may be used to enhance the vehicle, provide information or infotainment, driving, and/or safety. Exemplary vehicle systems include an audio system including microphones and/or speakers, autonomous driving system, an electronic stability control system, an anti-lock brake system, a brake assist system, an automatic brake prefill system, a low speed follow system, a cruise control system, a collision warning system, a collision mitigation braking system, an auto cruise control system, a lane departure warning system, a blind spot indicator system, a lane keep assist system, a navigation system, a transmission system, brake pedal systems, an electronic power steering system, visual devices (e.g., camera systems, proximity sensor systems), a climate control system, an electronic pretensioning system, a monitoring system, a passenger detection system, a vehicle suspension system, a vehicle seat configuration system, a vehicle cabin lighting system, a sensory system, among others.

The aspects discussed herein may be described and implemented in the context of non-transitory computer-readable storage medium storing computer-executable instructions. Non-transitory computer-readable storage media include computer storage media and communication media. For example, flash memory drives, digital versatile discs (DVDs), compact discs (CDs), floppy disks, and tape cassettes. Non-transitory computer-readable storage media may include volatile and non-volatile, removable and non-removable media implemented in any method or technology for storage of information such as computer readable instructions, data structures, modules, or other data.

FIG. 1 is a block diagram of an exemplary first system 100 for producing a virtual sound field. The first system 100 for producing the virtual sound field may enable audio communication to occur with a second system 102 for producing a virtual sound field. The audio communication provided by the first system 100 for producing the virtual sound field may enable a user to experience a phone call or other audio communication as if users using the second system 102 for producing the virtual sound field were present. Stated another way, the first system 100 for producing the virtual sound field may enable the user to experience audio in a directional sense or with added depth so that a first user using the first system 100 for producing the virtual sound field and a second user using the second system 102 for producing the virtual sound field receive sound or audio playback of signals so that the first user and the second user appear relative to one another within the same space (e.g., a virtual environment). In any event, the first system 100 for producing the virtual sound field will be described in greater detail below.

It will be appreciated that one or more components of the second system 102 for producing the virtual sound field may have or include identical functionality as the first system 100 for producing the virtual sound field. Further, as described herein, the first system 100 may be a local system for producing the virtual sound field, while the second system 102 may be a remote (e.g., relative to the local system) system for producing the virtual sound field. Additionally, it will be appreciated that the first system 100 for producing the virtual sound field and/or the second system 102 for producing the virtual sound field may be implemented on different devices or within different environments, such as within a vehicle, on a vehicle, within a helmet or motorcycle helmet, within a room of a house, etc.

In this regard, the first system 100 for producing the virtual sound field may include a set of binaural speakers 110, a set of binaural microphones 120, a processor 130, a memory 140, and communication interface 150. The set of binaural microphones 120 for the first system 100 for producing the virtual sound field may be 360 degree microphones. These components of the set of binaural speakers 110, the set of binaural microphones 120, the processor 130, the memory 140, and the communication interface 150 may be communicatively coupled with a controller area network (CAN) bus 160, such as when the first system 100 for producing the virtual sound field is implemented on a vehicle or within a vehicle, as will be described below. Similarly, the first system 100 for producing the virtual sound field may pass or transmit audio signals or receive audio signals from the second system 102 for producing the virtual sound field via the communication interface 150.

As previously indicated, the second system 102 for producing the virtual sound field may include one or more components which mirror or may be similar to the components of the first system 100 for producing the virtual sound field. For example, the second system 102 for producing the virtual sound field may include a set of binaural speakers 112, a set of binaural microphones 122, a processor 132, a memory 142, and a communication interface 152. The set of binaural microphones 122 for the second system 102 for producing the virtual sound field may be 360 degree microphones. These components may be communicatively coupled via the bus 162 which may or may not necessarily be a CAN bus, depending on whether the second system 102 for producing the virtual sound field is implemented within a second vehicle. One or more of the components of FIG. 1, such as the set(s) of binaural speakers 110, 112, the set(s) of binaural microphones 120, 122, the processor(s) 130, 132, and the memor(ies) may be operably connected to one another and may perform computer communication with one another, such as via the bus(es) 160, 162 or the communication interface(s) 150, 152. FIG. 1 will be described in greater detail with reference to FIGS. 3-10.

Figure 2:
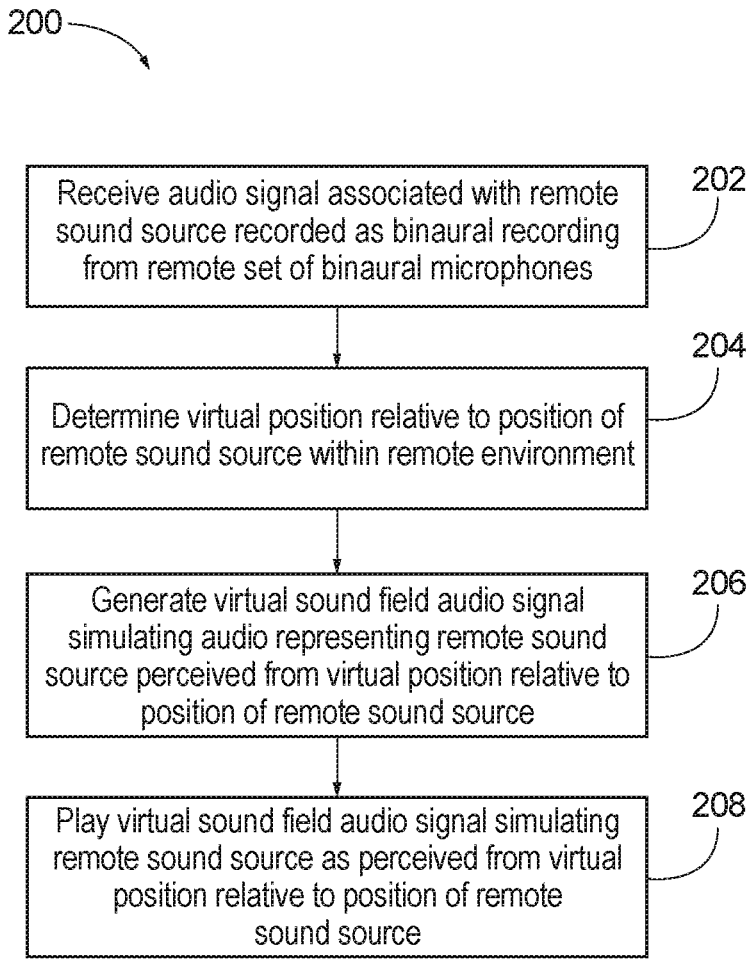
FIG. 2 is a flow diagram of an exemplary method for producing a virtual sound field, according to one aspect.

FIG. 2 is a flow diagram of an exemplary method 200 for producing a virtual sound field, according to one aspect. The method 200 for producing the virtual sound field may include receiving 202 an audio signal associated with a remote sound source within a remote environment. The audio signal associated with the remote sound source may be recorded or defined as a binaural recording and recorded from a remote set of binaural microphones 122. The audio signal associated with the remote sound source may be indicative of a position of the remote sound source relative to the remote set of binaural microphones 122 within the remote environment. The method 200 for producing the virtual sound field may include determining 204 a virtual position relative to the position of the remote sound source within the remote environment, generating 206 a virtual sound field audio signal which simulates audio representing the remote sound source perceived from the virtual position within the remote environment relative to the position of the remote sound source within the remote environment, and playing back 208 the virtual sound field audio signal to simulate the remote sound source as perceived from the virtual position relative to the position of the remote sound source within a local environment.

Figure 3:
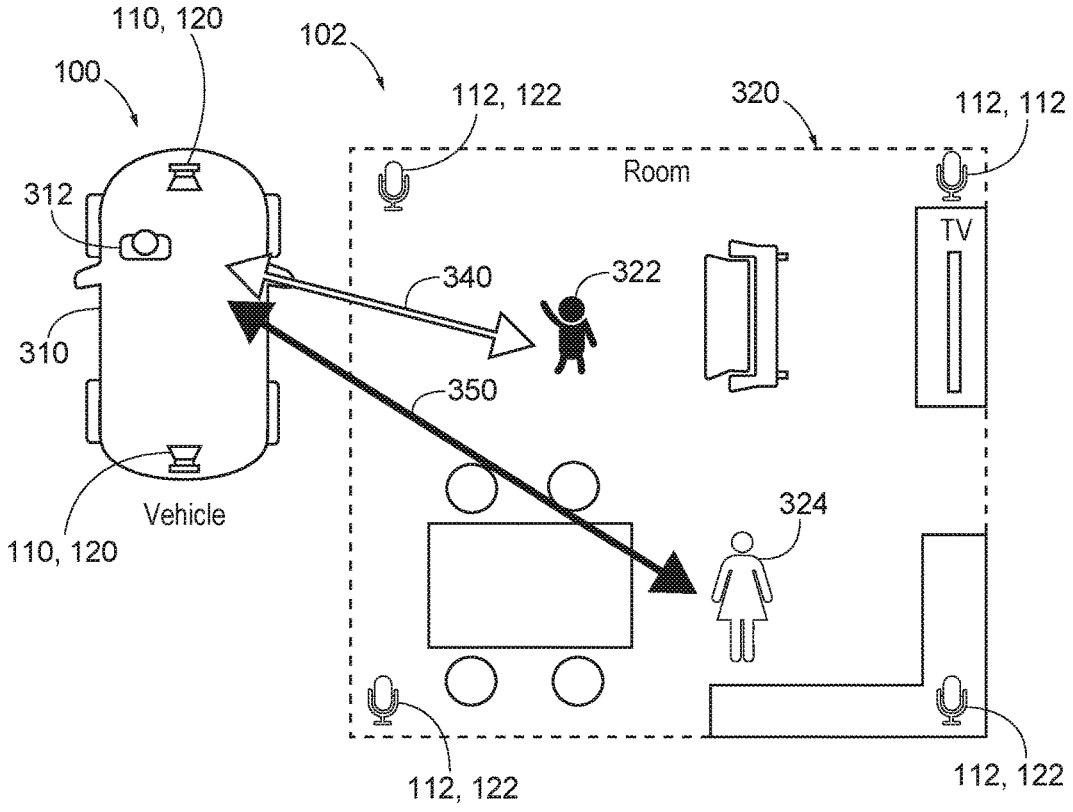
FIG. 3 is an exemplary scenario where the system and method for producing a virtual sound field may be implemented, according to one aspect.

FIG. 3 is an exemplary scenario where the system and method for producing the virtual sound field may be implemented, according to one aspect. In FIG. 3, the first system 100 for producing the virtual sound field may be implemented within a vehicle and the second system 102 for producing the virtual sound field may be implemented within a room of a house. As seen in FIG. 3, the first system 100 for producing the virtual sound field may be associated with a first environment 310 (e.g., the vehicle) and the second system 102 for producing the virtual sound field may be associated with a second environment 320 (e.g., the room). Here, a first user 312 may be positioned inside the vehicle or the first environment 310, and a second user 322 and a third user 324 may be positioned within the room or the second environment 320. Using the binaural speakers 110 and the binaural microphones 120 within the first environment 310, the first user 312 may communicate 340, 350 with the second user 322 and the third user 324. Similarly, using the binaural speakers 112 and the binaural microphones 122 within the second environment 320, the second user 322 and the third user 324 may communicate 340, 350 with the first user 312. According to one aspect, the first environment 310 may be a local environment and may be within a first vehicle. The second environment 320 may be a remote environment and may be within the room.

Figure 4:
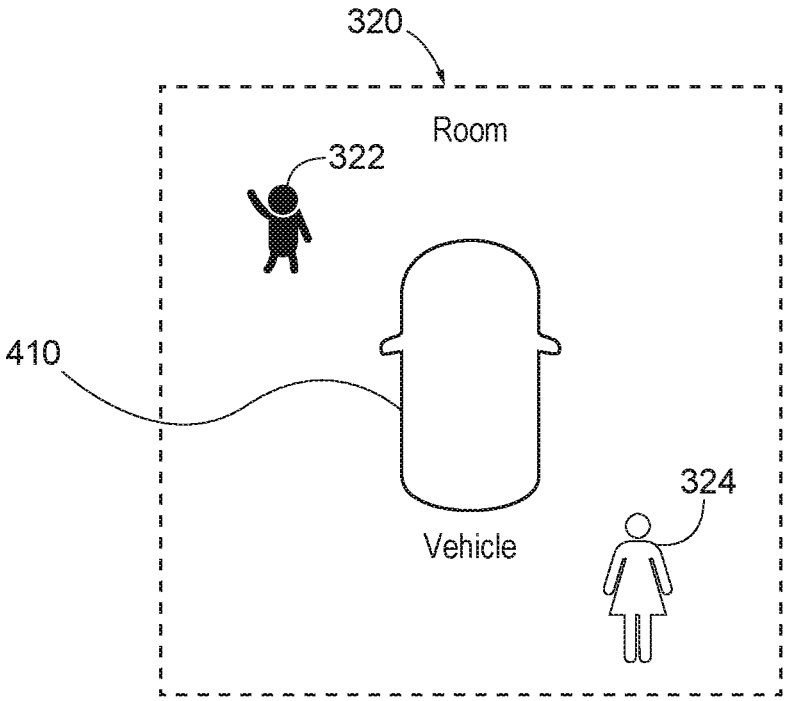
FIG. 4 is an exemplary scenario where the system and method for producing a virtual sound field may be implemented, according to one aspect.

FIG. 4 is an exemplary scenario where the system and method for producing the virtual sound field may be implemented, according to one aspect. In FIG. 4, it may be seen that the vehicle is assigned a virtual position 410 within the room or the second environment 320. The virtual position 410 may be determined with respect to the position of the actual users in the room, such as the second user 322 and the third user 324, for example. According to one aspect, the processor 130 may determine the virtual position 410 based on a user input or a user selection. According to one aspect, the processor 130 may determine the virtual position 410 based on a location or a position of another system for producing the virtual sound field. As seen in FIG. 4, the vehicle may be virtually positioned in a center of the room from the second user 322 and the third user 324. In playing back audio to the first user 312, the processor 130 may generate the audio signal of associated sound from the second user 322 to appear from the location associated with the second user 322 relative to the virtual position 410. Similarly, when the third user 324 speaks, the processor 130 may generate an audio signal for the speakers to play back audio which sounds as if the audio were coming from position of the third user 324 and travelling to virtual position 410.

Figure 5:
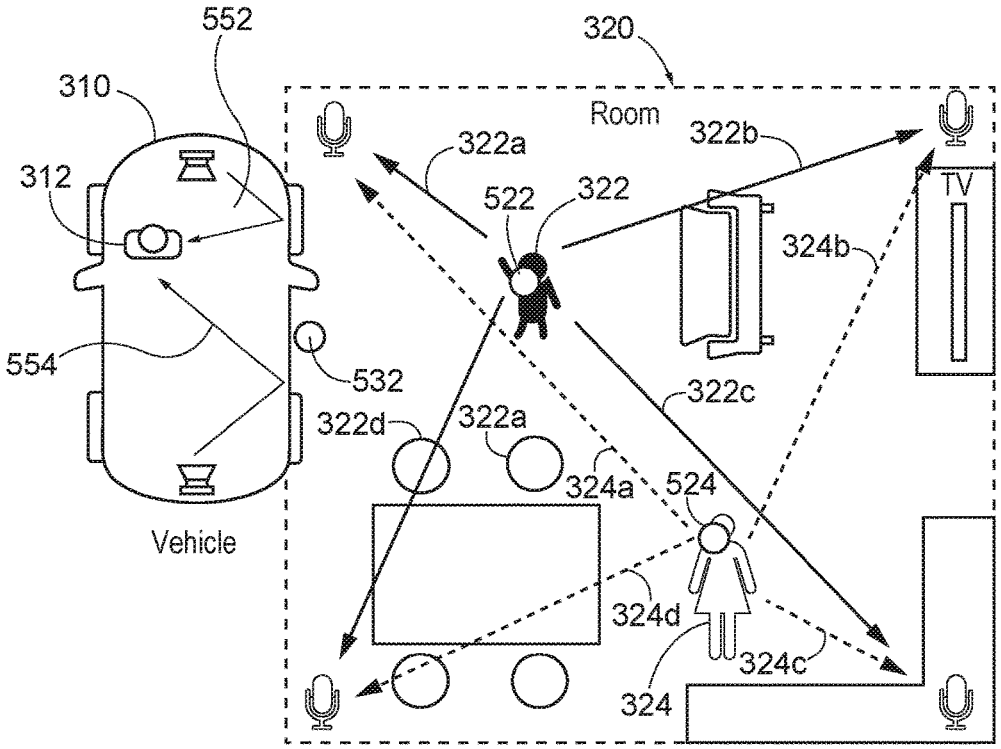
FIG. 5 is an exemplary scenario where the system and method for producing a virtual sound field may be implemented, according to one aspect.

FIG. 5 is an exemplary scenario where the system and method for producing the virtual sound field may be implemented, according to one aspect. Described with respect to FIG. 1, the first system 100 for producing the virtual sound field may be implemented within a vehicle and the second system 102 for producing the virtual sound field may be implemented within a room of a house. The first system 100 for producing the virtual sound field may be associated with a first environment (e.g., the vehicle) and the second system 102 for producing the virtual sound field may be associated with a second environment (e.g., the room). Here, the first user 312 may be positioned inside the vehicle or the first environment 310, and the second user 322 and the third user 324 may be positioned within the room or the second environment 320.

When the second user 322 (e.g., a remote sound source) speaks, the second set (e.g., remote set) of binaural microphones 122 within the second environment 320 (e.g., remote environment) may record the audio 322*a*, 322*b*, 322*c*, 322*d* as defined or recorded as a binaural recording. Similarly, when the third user speakers, the set of binaural microphones 122 within the second environment 320 may record the audio 324*a*, 324*b*, 324*c*, 324*d* as a binaural recording. These binaural recording(s) may be stored in the memory 142 of the second system 102 for producing the virtual sound field. In other words, the audio signal associated with the remote sound source or second user 322 may be defined as the binaural recording stored on the memory 142 and recorded from a remote set of binaural microphones 122. The audio signal associated with the remote sound source or the second user 322 may be indicative of a position of the remote sound source or the second user 322 relative to the remote set of binaural microphones 122 within the remote environment or second environment 320. The communication interface 152 of the second system 102 for producing the virtual sound field may transmit this captured audio signal to the communication interface 150 of the first system 100 for producing the virtual sound field, which may store the audio signal to the memory 140 via the CAN bus 160. In this way, the communication interface 150 may receive the audio signal associated with the remote sound source or the second user 322 within the remote environment or the second environment 320.

The processor 130 of the first system 100 for producing the virtual sound field may determine a virtual position 532 (e.g., for the first user 312) relative to the position of the remote sound source or the second user 322 within the remote environment or second environment 320. According to one aspect, the processor 130 may determine the virtual position 532 based on a user input or a user selection. In other words, one of the users 312, 322, 324 may select or set the desired virtual position as the virtual position 532. The local set of binaural speakers 110 may play the virtual sound field audio signal based on a head related transfer function. The local set of binaural speakers 110 may play the virtual sound field audio signal based on reflections 552, 554 of sound waves within the local environment to simulate the positioning of the first user 312, placing him or her at the virtual position 532 within the remote environment.

The processor 130 may generate a virtual sound field audio signal which simulates audio representing the remote sound source of the second user 322 in this example, perceived from the virtual position 532 within the remote environment or second environment 320 relative to the position of the remote sound source or the second user 322 within the remote environment or second environment 320. Stated another way, to the first user 312 sitting in the vehicle, the processor 130 may perform audio processing to determine or generate an audio signal which simulates a scenario where the sound or audio associated with the second user 322 appears to the first user to be coming from the right, thereby simulating the position of the first user 312 at the virtual position 532.

The local set of binaural speakers 110 may play or playback the virtual sound field audio signal to simulate the remote sound source as perceived from the virtual position 532 relative to the position of the remote sound source 522 within a local environment or first environment 310 associated with the system for producing the virtual sound field.

Conversely, when the first user 312 speaks, the systems operate in reverse. For example, the local set of binaural microphones 120 may receive an audio signal associated with a local sound source (e.g., the first user 312) within the local environment or first environment 310. The audio signal associated with the local sound source or the first user 312 may be defined as a binaural recording and recorded from the local set of binaural microphones 120. The audio signal associated with the local sound source may be indicative of the local sound source being positioned at the virtual position 532 relative to the remote sound source(s) 522 and 524. The memory 140 may store the associated audio signal and the communication interface 150 may pass this audio signal to the second system 102 for producing the virtual sound field, which may receive the audio signal, and generate a virtual sound field audio signal to simulate the local sound source as perceived from the position of the remote sound source 522 or 524 relative to the virtual position 532.

Figure 6:
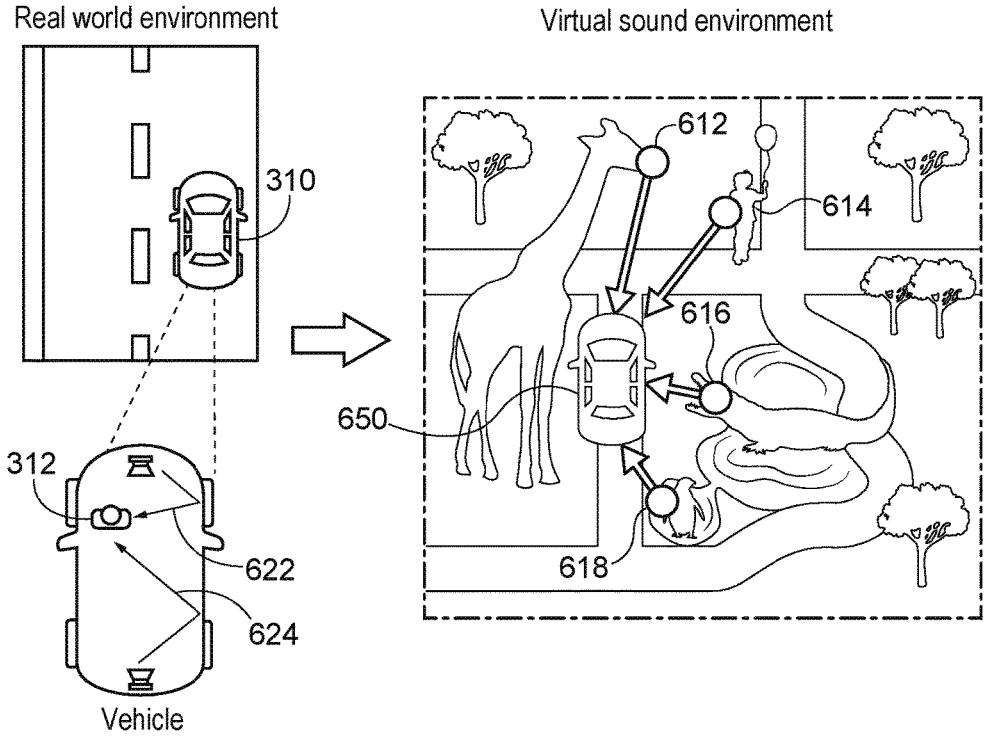
FIG. 6 is an exemplary scenario where the system and method for producing a virtual sound field may be implemented, according to one aspect.

FIG. 6 is an exemplary scenario where the system and method for producing the virtual sound field may be implemented, according to one aspect. Virtual sound sources may be simulated by the processor 130, according to some aspects. For example, the communication interface 150 may receive an audio signal associated with a virtual sound source within a virtual environment. The audio signal associated with the virtual sound source may, similarly to the above description, be defined as a binaural recording. The audio signal associated with the remote sound source may be indicative of a position of the virtual sound source within the remote environment. Examples of virtual sound sources may be seen in FIG. 6, such as a virtual giraffe 612, a virtual clown 614, a virtual crocodile 616, or a virtual penguin 618.

The processor 130 may determine a virtual position for the vehicle relative to the position of the virtual sound source within the virtual environment, thereby facilitating playback of the virtual sounds in the binaural fashion. The processor 130 may generate a virtual sound field audio signal which simulates audio representing the virtual sound source perceived from the virtual position within the remote environment relative to the position of the virtual sound source within the virtual environment. The local set of binaural speakers 110 may play the virtual sound field audio signal to simulate the virtual sound source(s) as perceived from the virtual position relative to the position of the virtual sound source(s) within the local environment or first environment 310 associated with the first system 100 for producing the virtual sound field. As previously discussed, the processor 130 may generate the virtual sound field signals so that the first user 312 or other occupants of the vehicle may experience sound as seen in the virtual sound environment from the virtual giraffe 612, the virtual clown 614, the virtual crocodile 616, or the virtual penguin 618 in a depth-wise, binaural, or directional manner. In other words, the first user 312 may experience sound corresponding to the virtual giraffe 612, the virtual clown 614, the virtual crocodile 616, or the virtual penguin 618 at a determined virtual position 650 relative to the virtual positions corresponding to 612, 614, 616, and 618, respectively. This may be achieved by reflecting the sound 622, 624 from the speakers to the first user 312.

Figure 7:
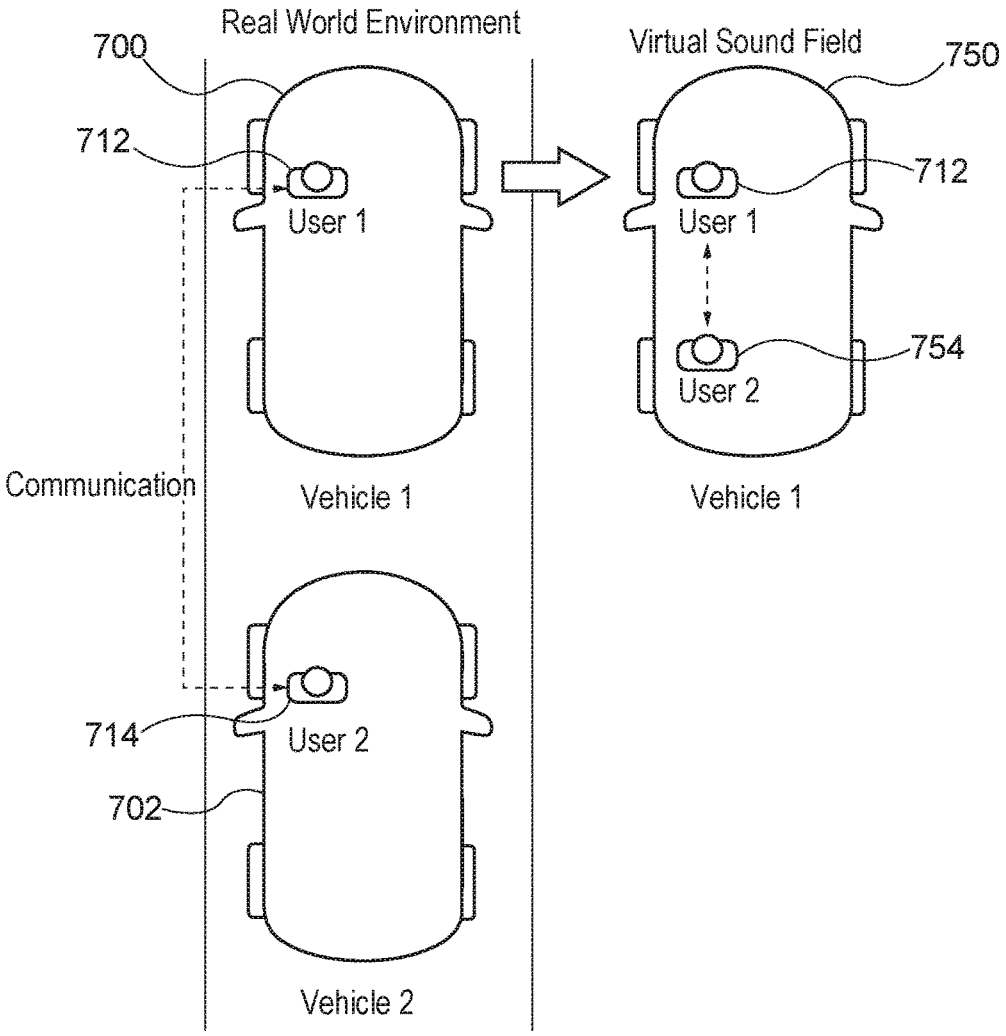
FIG. 7 is an exemplary scenario where the system and method for producing a virtual sound field may be implemented, according to one aspect.

FIG. 7 is an exemplary scenario where the system and method for producing the virtual sound field may be implemented, according to one aspect. According to one aspect, the first environment may be a local environment and may be within a first vehicle where the first system 700 for producing the virtual sound field is implemented. The second environment may be a remote environment and may be within a second vehicle where the second system 702 for producing the virtual sound field is implemented. According to one aspect, the processor 130 may determine the virtual position 754 based on a position of the second system 702 for producing the virtual sound field relative to a position of the first system 700 for producing the virtual sound field 750. As seen, if the first user 712 is in a first vehicle positioned ahead of a second vehicle, the processor 130 may generate the virtual sound field audio signal which simulates audio representing the second user 714 based on the position of the first vehicle relative to the position of the second vehicle. In other words, the processor may generate the virtual sound field audio signal which simulates audio representing the remote sound source (e.g., the second user 714) perceived from the virtual position (within the virtual sound field 750) within the remote environment relative to the position of the remote sound source within the remote environment. This may be seen within the virtual sound field 750 because the first user 712 is positioned in front of the virtual position 754 of the second user 714 within the virtual sound field 750.

Figure 8:
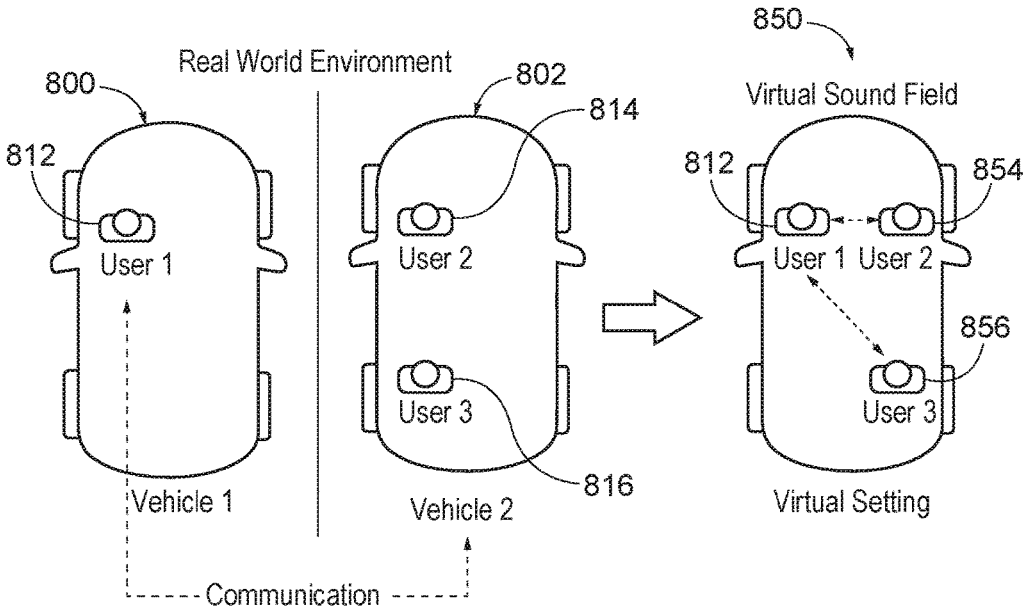
FIG. 8 is an exemplary scenario where the system and method for producing a virtual sound field may be implemented, according to one aspect.

FIG. 8 is an exemplary scenario where the system and method for producing the virtual sound field may be implemented, according to one aspect. Similarly to FIG. 7, the first environment of FIG. 8 may be a local environment and may be within a first vehicle 800. The second environment may be a remote environment and may be within a second vehicle 802. According to one aspect, the processor 130 may determine the virtual position 854, 856 based on a position of the second vehicle 802 equipped with the second system for producing the virtual sound field relative to a position of the first vehicle 800 equipped with the first system for producing the virtual sound field 850. Similarly to FIG. 7, the first user 812 is in the first vehicle 800 and the second user 814 and the third user 816 are in another vehicle (e.g., second vehicle 802). The processor may determine or setup a virtual sound field 850, which may be associated with an audio signal from the remote sound sources at virtual positions 854, 856 corresponding to the second user 814 and the third user 816. In this way, the processor of the system may determine the virtual position of the first user to be at 812 within the virtual sound field 850 relative to the position of the remote sound source(s) (e.g., the second user 814 and the third user 816) within the remote environment, as seen within the virtual sound field 850 where the first user 812 is at a first position, while the second user 814, when speaking may be perceived by the first user 812 to be speaking from the virtual position 854, and the third user 816, when speaking may be perceived by the first user 812 to be speaking from the virtual position 856.

Therefore, the processor 130 may determining the virtual position of the first user 812 relative to the positions 854, 856 of the remote sound source within the remote environment. Additionally, the processor may generate a virtual sound field audio signal which simulates audio representing the remote sound source(s) at 854, 856 perceived from the virtual position of the first user 812 within the remote environment relative to the position of the remote sound source(s) or users 814, 816 within the real world environment (e.g., based on the position of the vehicles relative to one another).

Figure 9:
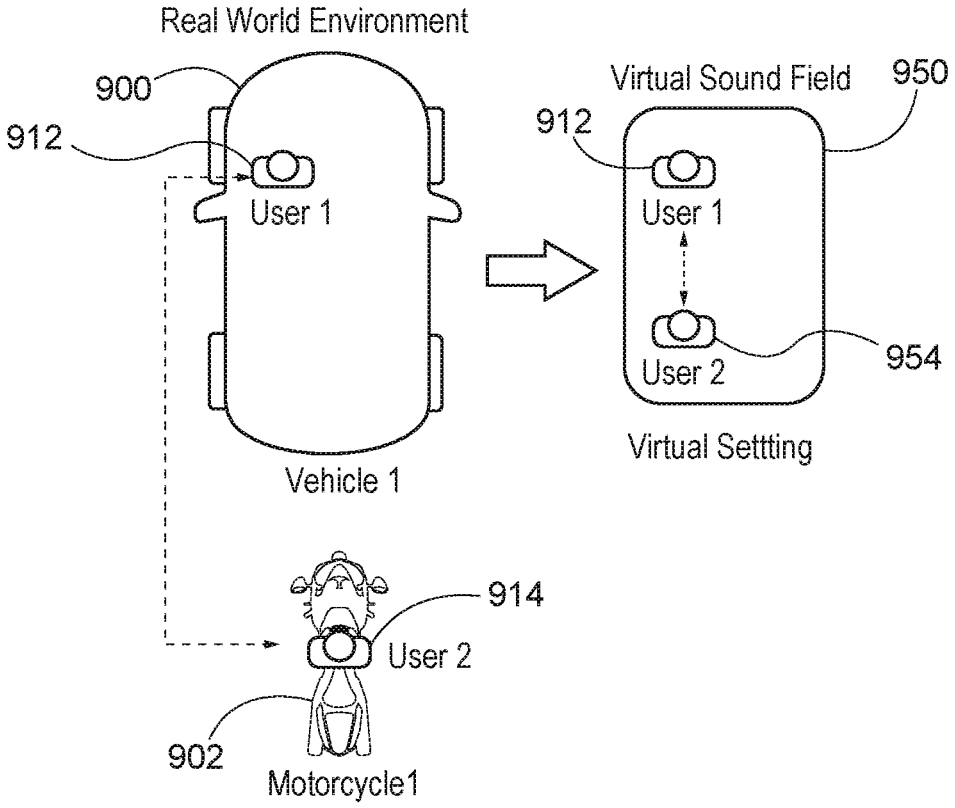
FIG. 9 is an exemplary scenario where the system and method for producing a virtual sound field may be implemented, according to one aspect.

FIG. 9 is an exemplary scenario where the system and method for producing the virtual sound field may be implemented, according to one aspect. The first environment of FIG. 9 may be a local environment and may be within a first vehicle 900 where a first user 912 is sitting. The second environment may be a remote environment and may be within a helmet of a motorcycle rider or second user 914. According to one aspect, the processor 130 may determine the virtual position 954 for the first system 100 for producing the virtual sound field based on a position of the motorcycle 902 equipped with the second system for producing the virtual sound field relative to a position of the first vehicle 900 equipped with the first system for producing the virtual sound field. In other words, because the motorcycle 902 is behind the first vehicle 900, the communications of the second user 914 may appear to come from the virtual position 954 determined by the processor 130 within a virtual sound field 950.

Figure 10:
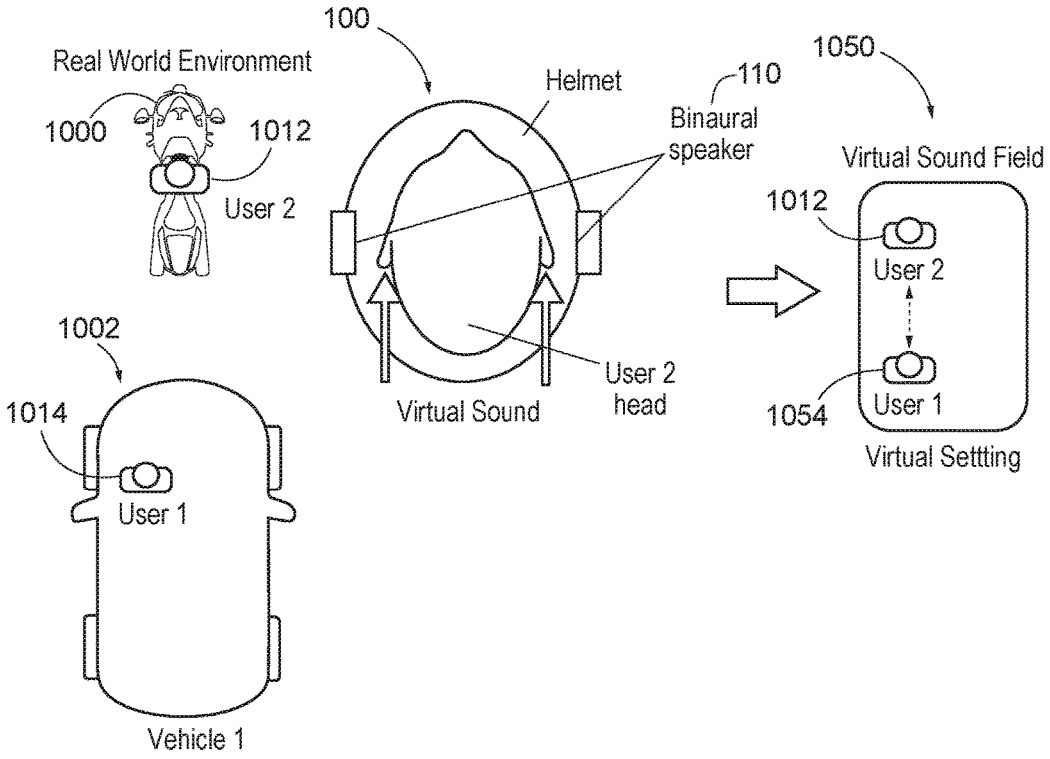
FIG. 10 is an exemplary scenario where the system and method for producing a virtual sound field may be implemented, according to one aspect.

FIG. 10 is an exemplary scenario where the system and method for producing the virtual sound field may be implemented, according to one aspect. According to one aspect, the first environment 1000 may be a local environment and may be within a helmet for a motorcycle rider or second user 1012. The second environment may be a remote environment and may be within a second vehicle 1002 where the first user 1014 is sitting. Thus, the first user 1014 is behind the second user 1012 in the real world environment. The processor 130 may setup the virtual sound field 1050 based on the configuration, arrangement, or positioning of the motorcycle being in front of the vehicle (and associated users 1012, 1014). In this regard, the first user 1014 may be assigned a virtual position 1054 within the virtual sound field 1050 relative to the second user 1012 riding the motorcycle. As seen in FIG. 10, the first system 100 may be implemented within a motorcycle helmet or helmet (e.g., may be a bicycle helmet, etc.) The binaural speakers 110 may playback sound or audio for the second user 1012 based on the position of the first user 1014 relative to the position of the second user 1012 in the real world environment.

It will be appreciated that the audio signals and communication described herein may occur in real time, such as or similar to a telephone call or other cellular or internet communication.

Figure 11:
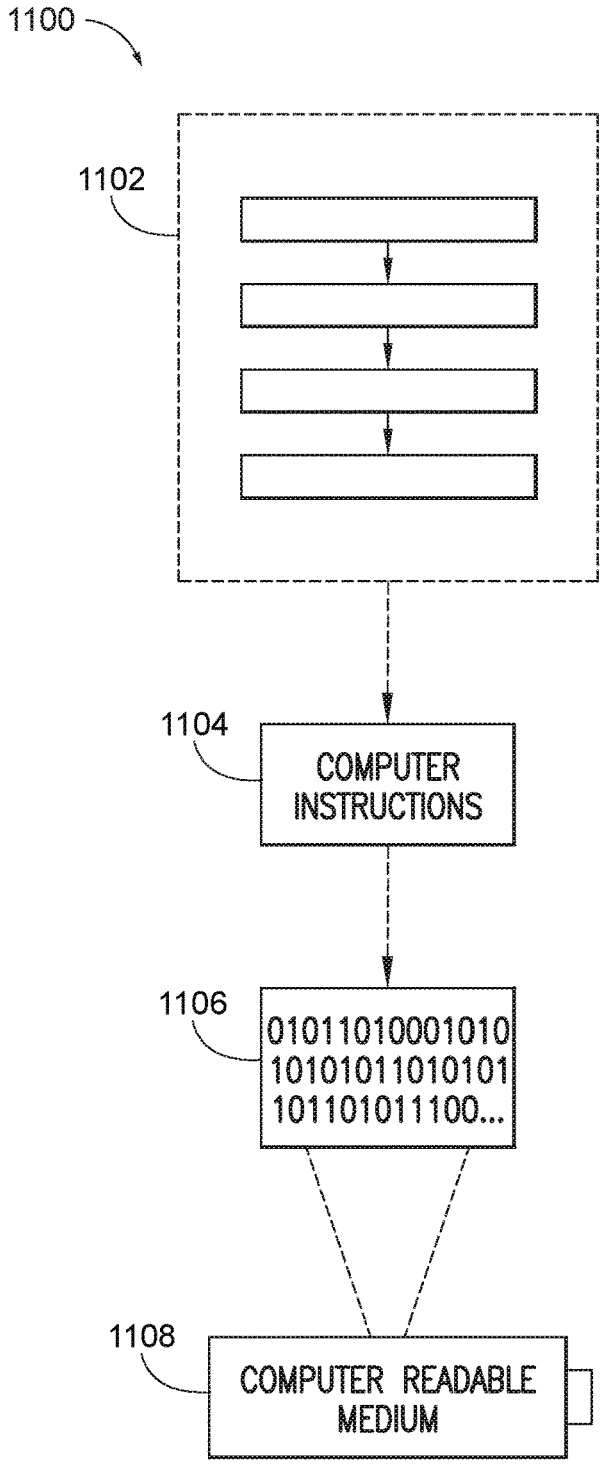
FIG. 11 is an illustration of an example computer-readable medium or computer-readable device including processor-executable instructions configured to embody one or more of the provisions set forth herein, according to one aspect.

Still another aspect involves a computer-readable medium including processor-executable instructions configured to implement one aspect of the techniques presented herein. An aspect of a computer-readable medium or a computer-readable device devised in these ways is illustrated in FIG. 11, wherein an implementation 1100 includes a computer-readable medium 1108, such as a CD-R, DVD-R, flash drive, a platter of a hard disk drive, etc., on which is encoded computer-readable data 1106. This encoded computer-readable data 1106, such as binary data including a plurality of zero's and one's as shown in 1106, in turn includes a set of processor-executable computer instructions 1104 configured to operate according to one or more of the principles set forth herein. In this implementation 1100, the processor-executable computer instructions 1104 may be configured to perform a method 1102, such as the method 200 of FIG. 2. In another aspect, the processor-executable computer instructions 1104 may be configured to implement a system, such as the system(s) 100 or 102 of FIG. 1. Many such computer-readable media may be devised by those of ordinary skill in the art that are configured to operate in accordance with the techniques presented herein.

As used in this application, the terms "component", "module," "system", "interface", and the like are generally intended to refer to a computer-related entity, either hardware, a combination of hardware and software, software, or software in execution. For example, a component may be, but is not limited to being, a process running on a processor, a processing unit, an object, an executable, a thread of execution, a program, or a computer. By way of illustration, both an application running on a controller and the controller may be a component. One or more components residing within a process or thread of execution and a component may be localized on one computer or distributed between two or more computers.

Further, the claimed subject matter is implemented as a method, apparatus, or article of manufacture using standard programming or engineering techniques to produce software, firmware, hardware, or any combination thereof to control a computer to implement the disclosed subject matter. The term "article of manufacture" as used herein is intended to encompass a computer program accessible from any computer-readable device, carrier, or media. Of course, many modifications may be made to this configuration without departing from the scope or spirit of the claimed subject matter.

Figure 12:
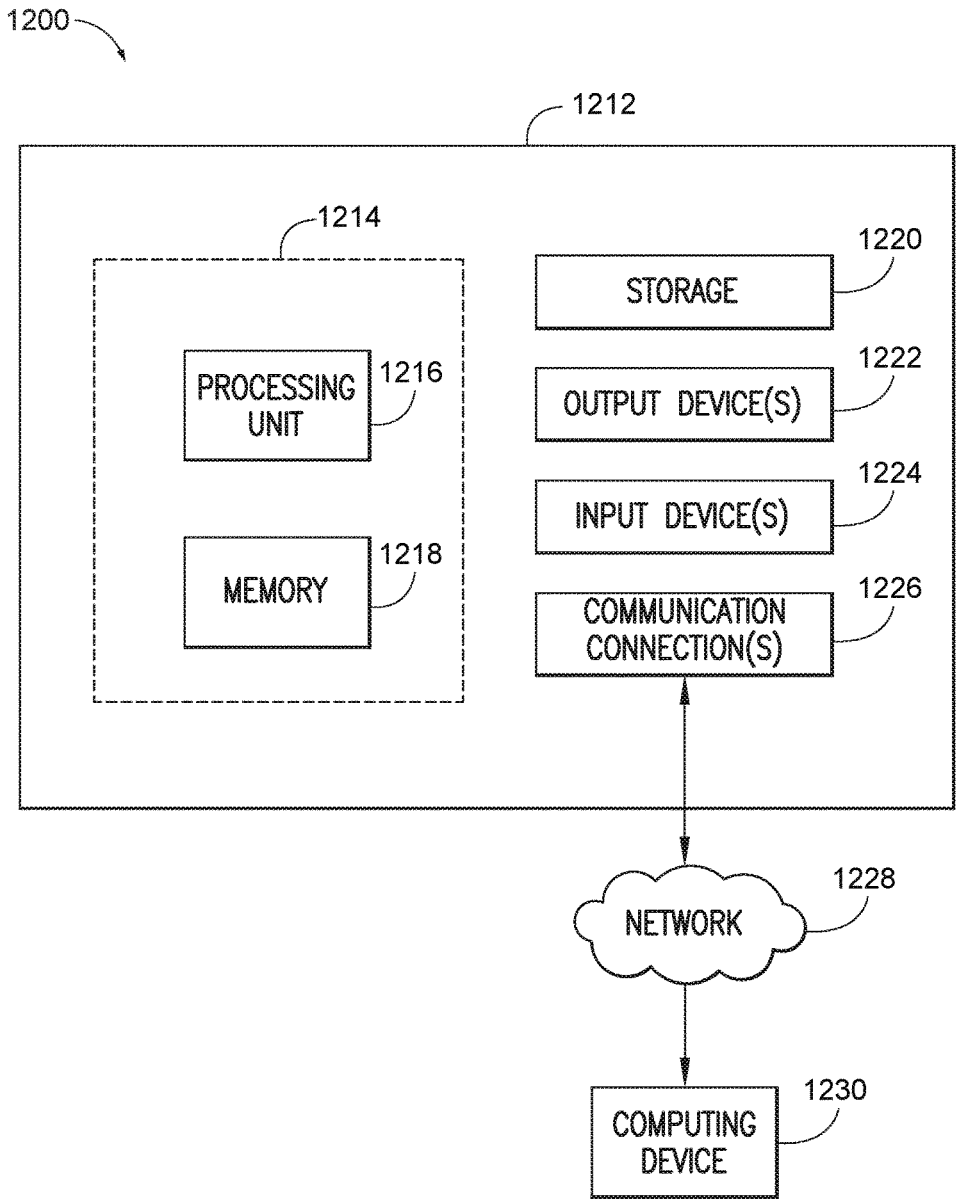
FIG. 12 is an illustration of an example computing environment where one or more of the provisions set forth herein are implemented, according to one aspect.

FIG. 12 and the following discussion provide a description of a suitable computing environment to implement aspects of one or more of the provisions set forth herein. The operating environment of FIG. 12 is merely one example of a suitable operating environment and is not intended to suggest any limitation as to the scope of use or functionality of the operating environment. Example computing devices include, but are not limited to, personal computers, server computers, hand-held or laptop devices, mobile devices, such as mobile phones, Personal Digital Assistants (PDAs), media players, and the like, multiprocessor systems, consumer electronics, mini computers, mainframe computers, distributed computing environments that include any of the above systems or devices, etc.

Generally, aspects are described in the general context of "computer readable instructions" being executed by one or more computing devices. Computer readable instructions may be distributed via computer readable media as will be discussed below. Computer readable instructions may be implemented as program modules, such as functions, objects, Application Programming Interfaces (APIs), data structures, and the like, that perform one or more tasks or implement one or more abstract data types. Typically, the functionality of the computer readable instructions are combined or distributed as desired in various environments.

FIG. 12 illustrates a system 1200 including a computing device 1212 configured to implement one aspect provided herein. In one configuration, the computing device 1212 includes at least one processing unit 1216 and memory 1218. Depending on the exact configuration and type of computing device, memory 1218 may be volatile, such as RAM, non-volatile, such as ROM, flash memory, etc., or a combination of the two. This configuration is illustrated in FIG. 12 by dashed line 1214.

In other aspects, the computing device 1212 includes additional features or functionality. For example, the computing device 1212 may include additional storage such as removable storage or non-removable storage, including, but not limited to, magnetic storage, optical storage, etc. Such additional storage is illustrated in FIG. 12 by storage 1220. In one aspect, computer readable instructions to implement one aspect provided herein are in storage 1220. Storage 1220 may store other computer readable instructions to implement an operating system, an application program, etc. Computer readable instructions may be loaded in memory 1218 for execution by processing unit 1216, for example.

The term "computer readable media" as used herein includes computer storage media. Computer storage media includes volatile and nonvolatile, removable and non-removable media implemented in any method or technology for storage of information such as computer readable instructions or other data. Memory 1218 and storage 1220 are examples of computer storage media. Computer storage media includes, but is not limited to, RAM, ROM, EEPROM, flash memory or other memory technology, CD-ROM, Digital Versatile Disks (DVDs) or other optical storage, magnetic cassettes, magnetic tape, magnetic disk storage or other magnetic storage devices, or any other medium which may be used to store the desired information and which may be accessed by the computing device 1212. Any such computer storage media is part of the computing device 1212.

The term "computer readable media" includes communication media. Communication media typically embodies computer readable instructions or other data in a "modulated data signal" such as a carrier wave or other transport mechanism and includes any information delivery media. The term "modulated data signal" includes a signal that has one or more of its characteristics set or changed in such a manner as to encode information in the signal.

The computing device 1212 includes input device(s) 1224 such as keyboard, mouse, pen, voice input device, touch input device, infrared cameras, video input devices, or any other input device. Output device(s) 1222 such as one or more displays, speakers, printers, or any other output device may be included with the computing device 1212. Input device(s) 1224 and output device(s) 1222 may be connected to the computing device 1212 via a wired connection, wireless connection, or any combination thereof. In one aspect, an input device or an output device from another computing device may be used as input device(s) 1224 or output device(s) 1222 for the computing device 1212. The computing device 1212 may include communication connection(s) 1226 to facilitate communications with one or more other devices 1230, such as through network 1228, for example.

Although the subject matter has been described in language specific to structural features or methodological acts, it is to be understood that the subject matter of the appended claims is not necessarily limited to the specific features or acts described above. Rather, the specific features and acts described above are disclosed as example aspects.

Various operations of aspects are provided herein. The order in which one or more or all of the operations are described should not be construed as to imply that these operations are necessarily order dependent. Alternative ordering will be appreciated based on this description. Further, not all operations may necessarily be present in each aspect provided herein.

As used in this application, "or" is intended to mean an inclusive "or" rather than an exclusive "or". Further, an inclusive "or" may include any combination thereof (e.g., A, B, or any combination thereof). In addition, "a" and "an" as used in this application are generally construed to mean "one or more" unless specified otherwise or clear from context to be directed to a singular form. Additionally, at least one of A and B and/or the like generally means A or B or both A and B. Further, to the extent that "includes", "having", "has", "with", or variants thereof are used in either the detailed description or the claims, such terms are intended to be inclusive in a manner similar to the term "comprising".

Further, unless specified otherwise, "first", "second", or the like are not intended to imply a temporal aspect, a spatial aspect, an ordering, etc. Rather, such terms are merely used as identifiers, names, etc. for features, elements, items, etc. For example, a first channel and a second channel generally correspond to channel A and channel B or two different or two identical channels or the same channel. Additionally, "comprising", "comprises", "including", "includes", or the like generally means comprising or including, but not limited to.

It will be appreciated that various of the above-disclosed and other features and functions, or alternatives or varieties thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A system for producing a virtual sound field, comprising:

a communication interface receiving an audio signal associated with a remote sound source within a remote environment, wherein the audio signal associated with the remote sound source is defined as a binaural recording and recorded from a remote set of binaural microphones and wherein the audio signal associated with the remote sound source is indicative of a position of the remote sound source relative to the remote set of binaural microphones within the remote environment;

a processor determining a virtual position relative to the position of the remote sound source within the remote environment and generating a virtual sound field audio signal which simulates audio representing the remote sound source perceived from the virtual position within the remote environment relative to the position of the remote sound source within the remote environment; and a local set of binaural speakers playing the virtual sound field audio signal to simulate the remote sound source as perceived from the virtual position relative to the position of the remote sound source within a local environment associated with the system for producing the virtual sound field.

2. The system for producing the virtual sound field of claim 1, comprising a local set of binaural microphones receiving an audio signal associated with a local sound source within the local environment.

3. The system for producing the virtual sound field of claim 2, wherein the audio signal associated with the local sound source is defined as a binaural recording and recorded from the local set of binaural microphones; and wherein the audio signal associated with the local sound source is indicative of the local sound source being positioned at the virtual position relative to the remote sound source.

4. The system for producing the virtual sound field of claim 1, wherein the remote set of binaural microphones include 360 degree microphones.

5. The system for producing the virtual sound field of claim 1, wherein the local environment is within a first vehicle.

6. The system for producing the virtual sound field of claim 5, wherein the remote environment is within a room or within a second vehicle.

7. The system for producing the virtual sound field of claim 1, wherein the local environment is within a helmet.

8. The system for producing the virtual sound field of claim 1, wherein the processor determines the virtual position based on a user input or a user selection.

9. The system for producing the virtual sound field of claim 1, wherein the local set of binaural speakers plays the virtual sound field audio signal based on a head related transfer function.

10. The system for producing the virtual sound field of claim 1, wherein the local set of binaural speakers plays the virtual sound field audio signal based on reflections of sound waves within the local environment.

11. A method for producing a virtual sound field, comprising:

receiving an audio signal associated with a remote sound source within a remote environment, wherein the audio signal associated with the remote sound source is defined as a binaural recording and recorded from a remote set of binaural microphones and wherein the audio signal associated with the remote sound source is indicative of a position of the remote sound source relative to the remote set of binaural microphones within the remote environment;

determining a virtual position relative to the position of the remote sound source within the remote environment;

generating a virtual sound field audio signal which simulates audio representing the remote sound source perceived from the virtual position within the remote environment relative to the position of the remote sound source within the remote environment; and playing back the virtual sound field audio signal to simulate the remote sound source as perceived from the virtual position relative to the position of the remote sound source within a local environment.

12. The method for producing the virtual sound field of claim 11, comprising receiving an audio signal associated with a local sound source within the local environment.

13. The method for producing the virtual sound field of claim 12, wherein the audio signal associated with the local sound source is defined as a binaural recording and recorded from a local set of binaural microphones; and wherein the audio signal associated with the local sound source is indicative of the local sound source being positioned at the virtual position relative to the remote sound source.

14. The method for producing the virtual sound field of claim 11, wherein the local environment is within a first vehicle.

15. The method for producing the virtual sound field of claim 14, wherein the remote environment is within a room or within a second vehicle.

16. The method for producing the virtual sound field of claim 11, wherein the local environment is within a helmet.

17. A system for producing a virtual sound field, comprising:

a communication interface receiving an audio signal associated with a remote sound source within a remote environment, wherein the remote sound source is a virtual sound source and the remote environment is a virtual environment, wherein the audio signal associated with the remote sound source is defined as a binaural recording and wherein the audio signal associated with the remote sound source is indicative of a position of the remote sound source relative to the remote environment;

a processor determining a virtual position relative to the position of the remote sound source within the remote environment and generating a virtual sound field audio signal which simulates audio representing the remote sound source perceived from the virtual position within the remote environment relative to the position of the remote sound source within the remote environment; and a local set of binaural speakers playing the virtual sound field audio signal to simulate the remote sound source as perceived from the virtual position relative to the position of the remote sound source within a local environment associated with the system for producing the virtual sound field.

18. The system for producing the virtual sound field of claim 17, wherein the local environment is within a vehicle.

19. The system for producing the virtual sound field of claim 17, wherein the local environment is within a helmet.

20. The system for producing the virtual sound field of claim 17, wherein the processor determines the virtual position based on a user input or a user selection.

* * * * *